US009217987B2

(12) United States Patent
Masuda

(10) Patent No.: US 9,217,987 B2
(45) Date of Patent: Dec. 22, 2015

(54) IMAGE FORMING APPARATUS

(71) Applicant: CANON KABUSHIKI KAISHA, Tokyo (JP)

(72) Inventor: Shinichi Masuda, Numata (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/535,603

(22) Filed: Nov. 7, 2014

(65) Prior Publication Data

US 2015/0132022 A1 May 14, 2015

(30) Foreign Application Priority Data

Nov. 14, 2013 (JP) ..... 2013-236203

(51) Int. Cl.
*G03G 21/16* (2006.01)

(52) U.S. Cl.
CPC ..... *G03G 21/1647* (2013.01)

(58) Field of Classification Search
CPC ..... G03G 21/1633; G03G 21/1638; G03G 2221/1675
See application file for complete search history.

(56) References Cited

U.S. PATENT DOCUMENTS

| | | | | |
|---|---|---|---|---|
| 7,647,003 | B2 * | 1/2010 | Itabashi | 399/110 |
| 2011/0075213 | A1 * | 3/2011 | Murayama | 358/1.15 |
| 2014/0294428 | A1 * | 10/2014 | Iketani | 399/98 |

FOREIGN PATENT DOCUMENTS

| | | | |
|---|---|---|---|
| JP | 7-128922 | A | 5/1995 |
| JP | 2007065273 | A | 3/2007 |
| JP | 2010204281 | A | 9/2010 |
| JP | 2011-191400 | A | 9/2011 |
| JP | 2013166390 | A | 8/2013 |
| WO | 2013141219 | A1 | 9/2013 |

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes an apparatus body composing the image forming apparatus, a unit drawably stored in the apparatus body, a lock mechanism provided in the unit and configured to lock the unit in a state in which the unit is stored in the apparatus body, a display portion provided on an upper surface part of the apparatus body, and an unlock mechanism configured to unlock the lock mechanism. The unlock mechanism includes an operating portion provided in a region facing the display portion of the upper surface part of the unit and operated in unlocking the lock mechanism.

14 Claims, 10 Drawing Sheets

IMAGE FORMING APPARATUS

BACKGROUND OF THE INVENTION

1. Field of the Invention

The present invention relates to an image forming apparatus and more specifically to an image forming apparatus provided with a unit drawably within a body of the image forming apparatus.

2. Description of the Related Art

A conventional image forming apparatus such as a copier and a printer is configured to form an image on a sheet conveyed to an image forming portion from a sheet storage portion and to discharge the sheet to which the image has been formed out of a body of the image forming apparatus (referred to an 'image forming apparatus body' or an 'apparatus body' hereinafter). Here, there is such an image forming apparatus configured to be able to draw out a unit drawably stored within the apparatus body in conducting such works as removal of a jammed sheet and replacement of component parts.

A sheet feed cassette may be cited as such a unit drawably provided within the apparatus body, and Japanese Patent Application Laid-open No. Hei. 7-128922 discloses an image forming apparatus configured to remove a jammed sheet, in a case where jamming occurs, by drawing a sheet feed cassette out of an apparatus body. As another unit, Japanese Patent Application Laid-open No. 2011-191400 discloses a reversal unit configured to convey a sheet on which an image has been formed on one surface thereof to an image forming portion again so that an image is formed on a back of the sheet. Then, in a case where the sheet jams, the reversal unit is drawn out of the apparatus body to remove the jammed sheet.

By the way, the conventional image forming apparatus is configured to lock the sheet feed cassette and the reversal unit within the apparatus body by a lock mechanism. Then, in the case where a sheet jams for example, the image forming apparatus is configured to remove the jammed sheet by drawing the unit out of the apparatus body after unlocking the lock mechanism by operating an unlocking member. However, in a case where the unlocking member is provided on a back of the apparatus body, it is unable to readily draw the unit out of the apparatus body because a user has to move to the back of the image forming apparatus and to operate the unlocking member in conducting an unjamming process.

Still further, conventionally, a procedure for removing a jammed sheet out of a conveying path for example is displayed on a display portion provided on an upper surface of the image forming apparatus so that such a process as an unjamming process is reliably conducted after drawing the unit out of the apparatus body. However, in the case where the user moves to the back side of the image forming apparatus to operate the unlocking member, there is a possibility that an erroneous operation is conducted because the user is unable to conduct the unjamming process while confirming the procedure displayed on the display portion.

SUMMARY OF THE INVENTION

This disclosure provides an image forming apparatus comprising:

an apparatus body;

a unit drawably stored in the apparatus body;

a lock mechanism provided in the unit and configured to lock the unit in a state in which the unit is stored in the apparatus body;

a display portion provided on an upper surface part of the apparatus body; and an unlock mechanism configured to unlock the lock mechanism, the unlock mechanism including an operating portion provided in a region facing the display portion of an upper surface part of the unit and operated in unlocking the lock mechanism.

Further features of the present invention will become apparent from the following description of exemplary embodiments (with reference to the attached drawings).

DESCRIPTION OF THE EMBODIMENTS

Figure 1:
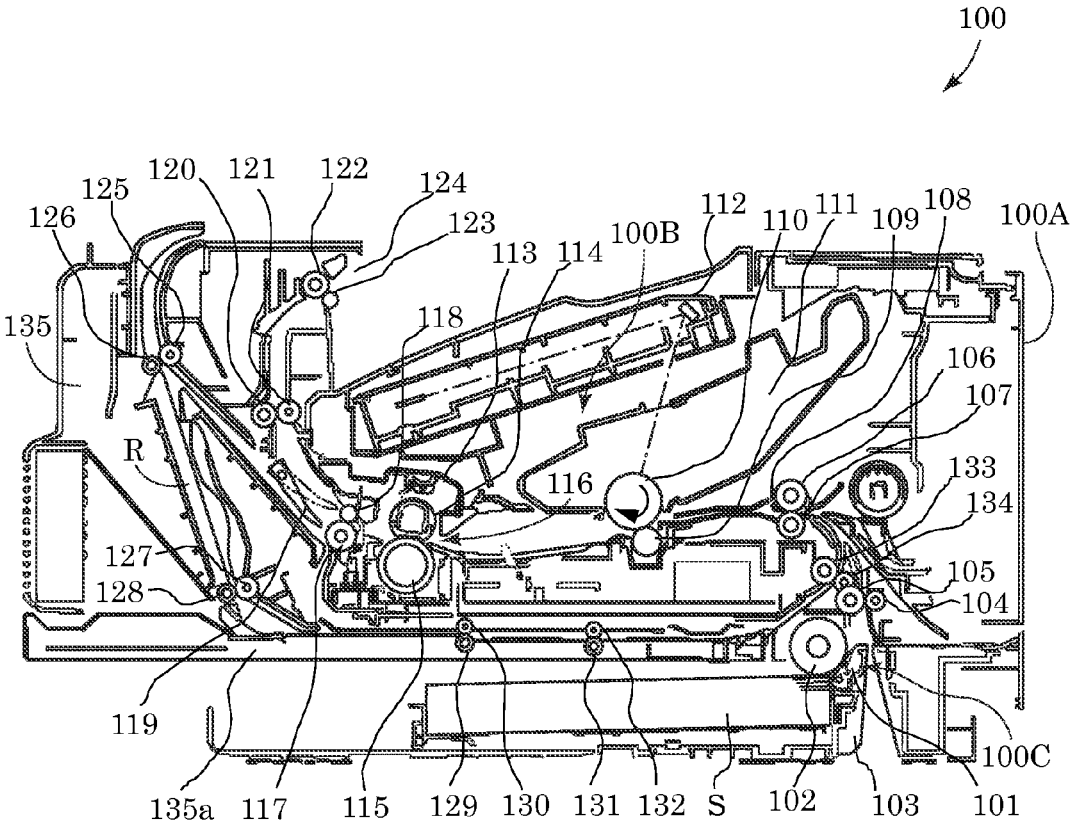
FIG. 1 is a schematic diagram showing an entire structure of an image forming apparatus according to an embodiment of the present invention.

An embodiment of the invention will be described below in detail with reference to the drawings. FIG. 1 is a schematic diagram showing an entire structure of an image forming apparatus of the embodiment of the invention. In FIG. 1, the image forming apparatus 100 includes an image forming apparatus body 100A (referred to simply as an 'apparatus body' hereinafter). The apparatus body 100A includes an image forming portion 100B having a photosensitive drum 110 and others and a sheet feeding apparatus 100C provided at a lower part of the apparatus body 100A and configured to feed a sheet S such as a recording medium stacked and stored in a sheet feed cassette 103 to the image forming portion 100B.

Figure 10:
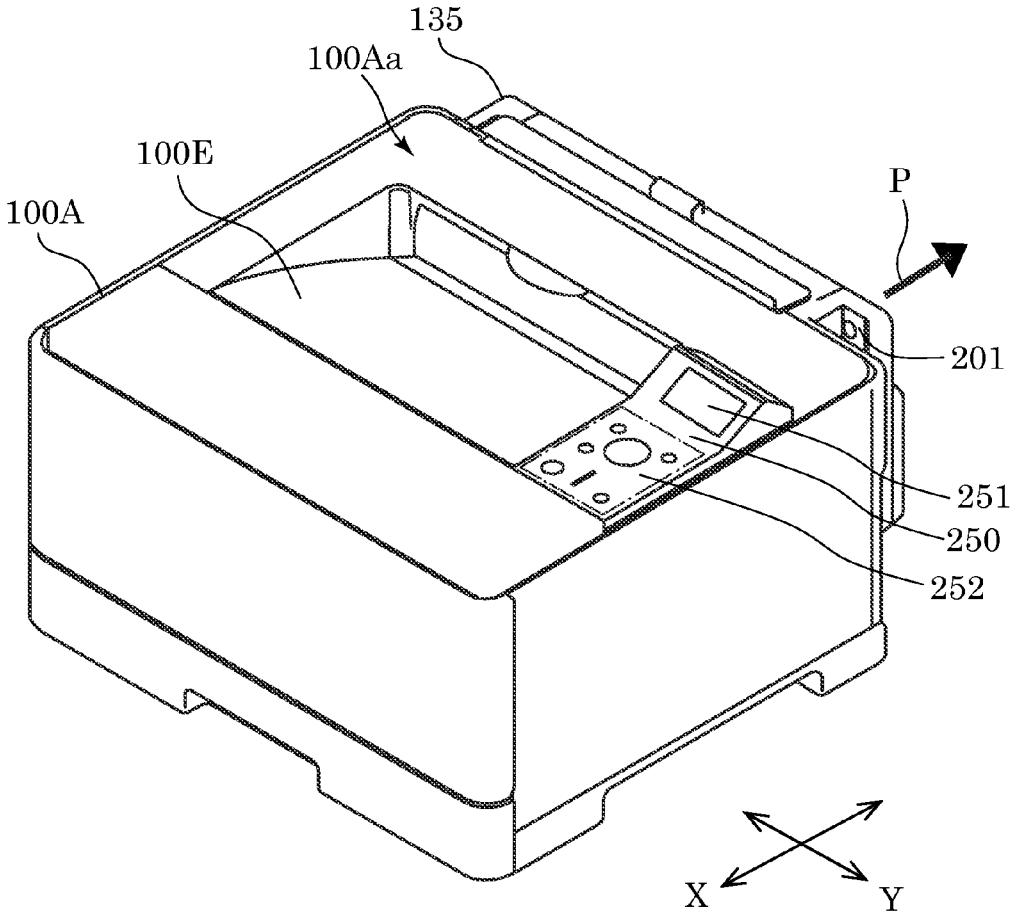
FIG. 10 is a perspective view showing a position of an opening/closing lever composing the lock portion of the embodiment.

This apparatus body 100A also includes a transfer roller 109 coming into contact with the photosensitive drum 110 and composing a transfer portion together with the photosensitive drum 110, a fixing unit 113 fixing a toner image transferred in the transfer portion to the sheet S, and others. Then, a duplex unit 135 is disposed between the image forming portion 100B and the sheet feed cassette 103. The duplex unit 135 includes a reverse conveying path R which is a sheet conveying path for reversing and conveying a sheet on which an image has been formed on a first surface thereof again to the image forming portion 100B. It is noted that the duplex unit 135, i.e., a sheet reverse conveying portion, is disposed drawably within the apparatus body 100A. It is noted that in the present embodiment, a drawing direction X of the duplex unit 135 is a short direction and an orthogonal direction (width direction) Y orthogonal to the drawing direction X is a longitudinal direction of the apparatus body 100A as shown in FIG. 10.

Here, the image forming portion 100B includes a process cartridge 111 including the photosensitive drum 110, and a charger, a developer sleeve, a cleaning portion and others not shown. The image forming portion 100B also includes a laser scanner 112, i.e., an exposure unit, forming an electrostatic latent image on a surface of the photosensitive drum 110 by exposing the surface of the photosensitive drum 110. The sheet feeding apparatus 100C includes a pickup roller 102, i.e., a sheet feeding member, feeding an uppermost sheet S stacked in the sheet feed cassette 103. The sheet feeding apparatus 100C also includes a separation pad 101 being in pressure contact with the pickup roller 102 and separating and conveying the sheet S fed from the pickup roller 102 one by one together with the pickup roller 102.

Next, an image forming operation of the image forming apparatus 100 constructed as described above will be explained. In response to a start of the image forming operation, the photosensitive drum 110 rotates in a direction of an arrow indicated in FIG. 1 at first such that the surface thereof is charged by the charger not shown. Then, a laser beam is irradiated to the photosensitive drum 110 on a basis of image information from the laser scanner 112. Thereby, an electrostatic latent image is formed on the surface of the photosensitive drum 110. Next, toner adequately electrified by rotation of the developing sleeve not shown is supplied on the photosensitive drum 110, so that this electrostatic latent image is developed and visualized as a toner image.

Meanwhile, in parallel with such a toner image forming operation, the pickup roller 102 rotates by being driven by a driving motor not shown and feeds the uppermost sheet S in the sheet feed cassette 103. The sheet S fed by the pickup roller 102 is conveyed while being separated one by one by a separating portion composed of the pickup roller 102 and the separation pad 101. After that, the sheet S is conveyed through a conveying roller pair 104 and 105 to a registration roller pair 106 and 107.

Here, the registration driven roller 106 composing the registration roller pair 106 and 107 is provided with a coaxially rotatable registration shutter 108 such that the registration shutter 108 corrects a skew of the sheet S conveyed thereto. The sheet S whose skew has been corrected is conveyed to the transfer portion by the registration roller pair 106 and 107, and the image on the photosensitive drum 110 is transferred to the sheet S by the transfer roller 109. After that, the sheet S on which the toner image has been transferred is conveyed to a fixing nip portion 116 formed of a heating unit 114 and a pressure roller 115 being pressure contact with each other of the fixing unit 113 so that the non-fixed toner image is fixed on a surface of the sheet S by receiving heat and pressure.

The sheet S on which the toner image has been fixed is conveyed to a conveying roller pair 117 and 118 and is then conveyed to an intermediate discharge roller pair 120 and 121 by being guided by a switching member 119 located at a position indicated by a solid line in FIG. 1. Then, the sheet S is conveyed to a discharge roller pair 122 and 123 by the intermediate discharge roller pair 120 and 121 and is then discharged out of the apparatus body 100A through a discharge port 124.

Meanwhile, in a case of forming images on both surfaces of the sheet S, the sheet S is conveyed to a normally/reversely rotatable switchback roller pair 125 and 126 by being guided by the switching member 119 that has moved to a position indicated by a dot line in FIG. 1 after being conveyed to the conveying roller pair 117 and 118. Then, the sheet S is conveyed by a predetermined distance by normal rotation of the switchback roller pair 125 and 126 and is then conveyed to a reverse conveying path R of the duplex unit 135 by reverse rotation of the switchback roller pair 125 and 126.

After that, the sheet S is conveyed through duplex first, second, third and fourth roller pairs 127 and 128, 129 and 130, 131 and 132, and 133 and 134 provided respectively along the reverse conveying path R. Then, the sheet S is conveyed again to the registration roller pair 106 and 107 by the duplex fourth roller pair 133 and 134. After that, the sheet is conveyed by the registration roller pair 106 and 107 to the transfer portion where an image is formed on a back side of the sheet S. After that, the image formed on the back side of the sheet S is fixed by the fixing unit 113 and then the sheet S is discharged out of the apparatus.

Figure 2:
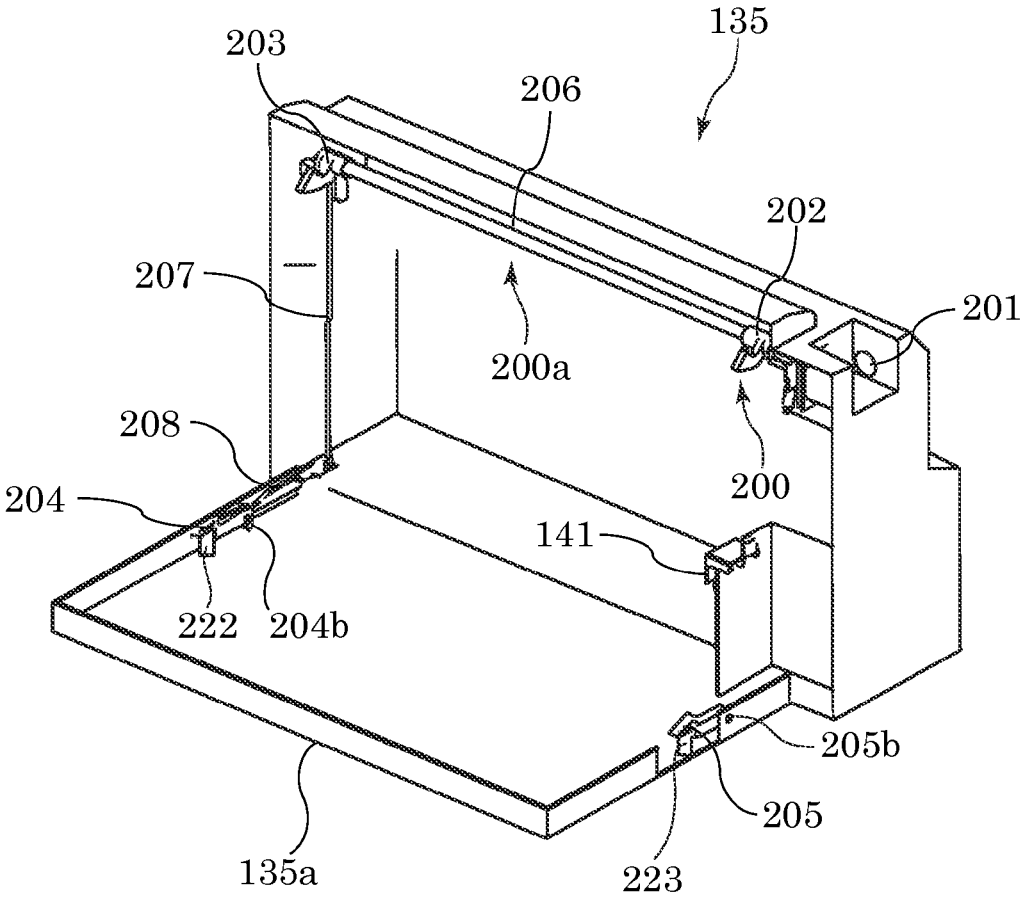
FIG. 2 is a perspective view showing a configuration of a duplex unit drawably provided within the image forming apparatus of the embodiment.
Figure 3:
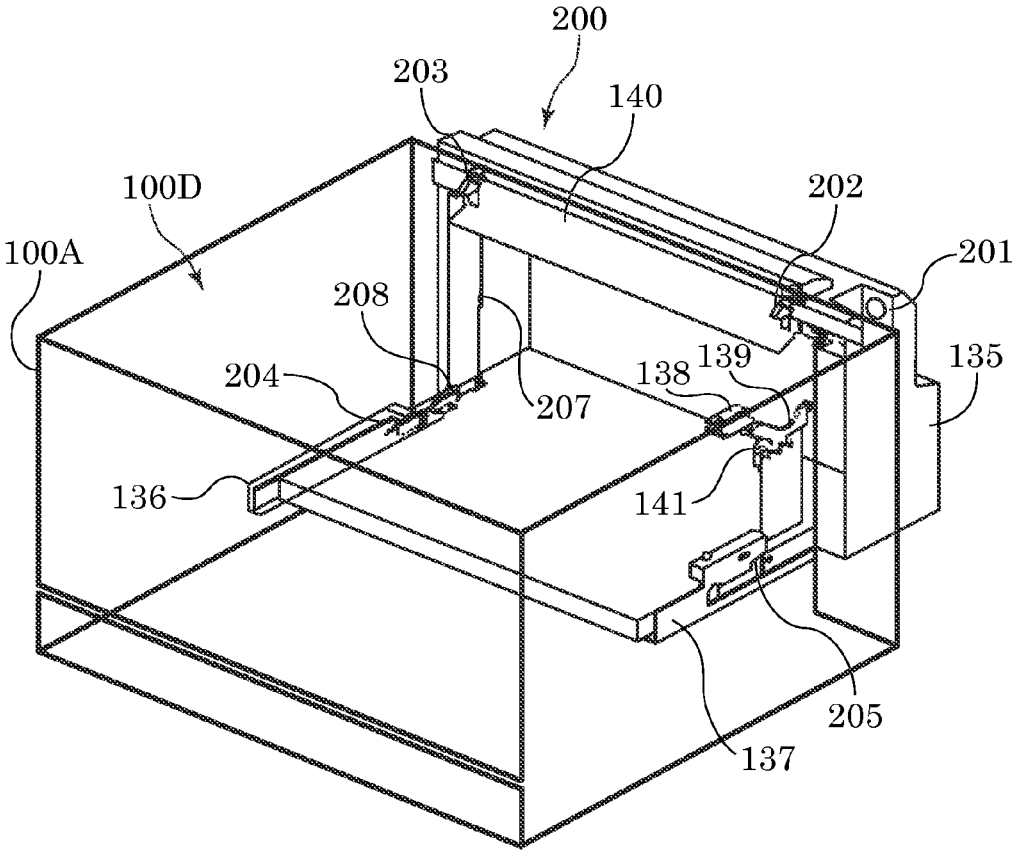
FIG. 3 illustrates a lock portion configured to lock the duplex unit of the embodiment.
Figure 4:
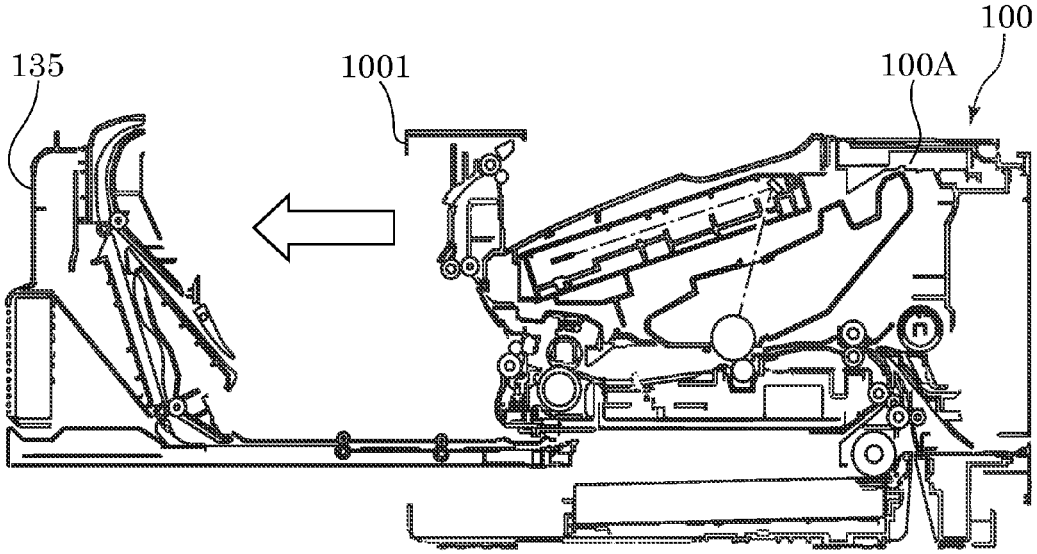
FIG. 4 illustrates a state in which the duplex unit of the present embodiment is drawn out.

Here, the duplex unit 135, i.e., one exemplary unit drawably provided in the apparatus body 100A, is provided with a support portion 135*a* at a lower end part of the duplex unit 135 as shown in FIG. 2. It is noted that component parts such as the switching member 119 and the switchback roller pair 125 and 126 are not shown in FIG. 2. The duplex unit 135 is configured to be drawably stored (disposed) within the apparatus body 100A by mounting both end portions of the support portion 135*a* on guide rails 136 and 137 provided so as to face inner walls of a storage portion 100D provided at a lower part of the apparatus body 100A as shown in FIG. 3. Then, in a case where jamming of the sheet or the like occurs in the fixing unit 113 or the duplex unit 135, a user of the image forming apparatus is allowed to conduct an unjamming work by drawing the duplex unit 135 out of the apparatus body 100A in a direction of an arrow as indicated in FIG. 4.

It is noted that the storage portion 100D is provided with a detection switch 138 detecting that the duplex unit 135 is stored at a normal storage position as shown in FIG. 3. The storage portion 100D is also provided with a flag 139 turning ON/OFF the detection switch 138 as shown in FIG. 3. Meanwhile, the duplex unit 135 is provided with a switch arm 141 as shown in FIG. 2. Then, when the duplex unit 135 is stored in the storage portion 100D, the flag 139 is pressed and moved by the switch arm 141, thus turning ON the detection switch 138. Thereby, a control portion not shown detects that the duplex unit 135 is stored within the storage portion 100D.

By the way, the duplex unit 135 is normally locked in a state in which the duplex unit 135 is stored in the storage portion 100D by a lock portion 200 as shown in FIG. 3. Then, the duplex unit 135 is configured such that the user can draw the duplex unit 135 out of the storage portion 100D as shown in FIG. 4 by unlocking the lock portion 200 when jamming or the like occurs.

Figure 8:
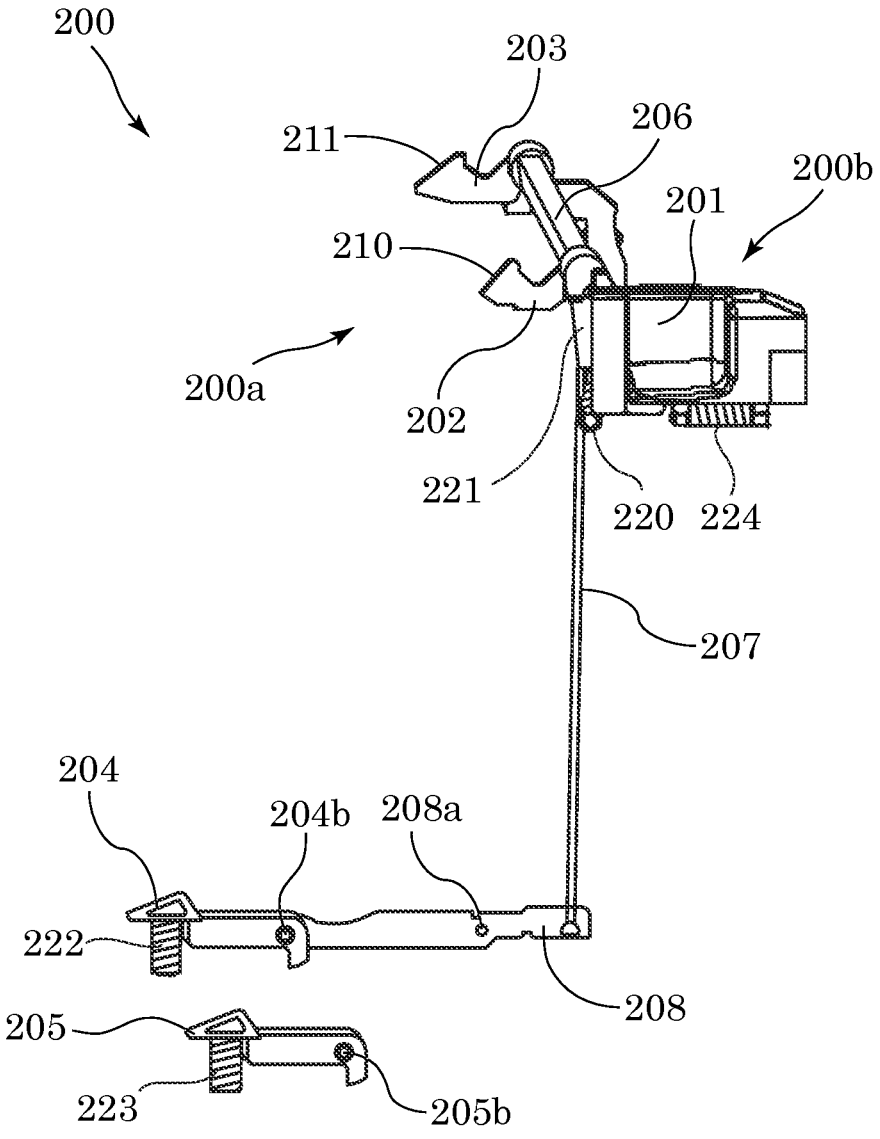
FIG. 8 illustrates the lock portion of the embodiment.

Next, the lock portion 200 configured to lock the duplex unit 135 as described above will be explained. As shown in FIG. 8, the lock portion 200 includes a lock mechanism 200*a* provided in the duplex unit 135 and locking the duplex unit 135 in the state in which the duplex unit 135 is stored within the apparatus body 100A and a unlock mechanism 200*b* capable of unlocking the lock mechanism 200*a*. The lock mechanism 200*a* includes first, second and third interlocked hooks 202, 203 and 204, and an independent hook 205. The unlock mechanism 200*b* includes an opening/closing lever 201 (operating portion) operated in unlocking the lock mechanism 200*a*. That is, as shown in FIG. 2, the lock portion 200 includes the first, second and third interlocked hooks 202, 203 and 204, the independent hook 205, and the opening/closing lever 201 provided at an end portion of the duplex unit 135 to unlock the lock mechanism 200*a*. Thus, the lock portion 200 is configured to lock the duplex unit 135 by the first through third interlocked hooks 202 through 204 and the independent hook 205 and to unlock the duplex unit 135 by the opening/closing lever 201, i.e., an operating portion of an unlock mechanism, in the present embodiment.

It is noted that the duplex unit 135 also includes a lock shaft 206 rotatably provided at an upper part of the duplex unit 135 as shown in FIG. 2. The first interlocked hook 202 is fixed near the opening/closing lever 201 which is located at one end side in a width direction orthogonal to the drawing direction of the locking shaft 206, and the second interlocked hook 203 is fixed at another widthwise end of the locking shaft 206. A wire, i.e., a transmission member, 207 whose one end is connected to a link arm 208 is connected to the other end side of the locking shaft 206. Then, the third interlocked hook 204 provided at the other end side of a lower part of the duplex unit 135 is vertically rotatably connected to an edge portion of the link arm 208.

Figure 5:
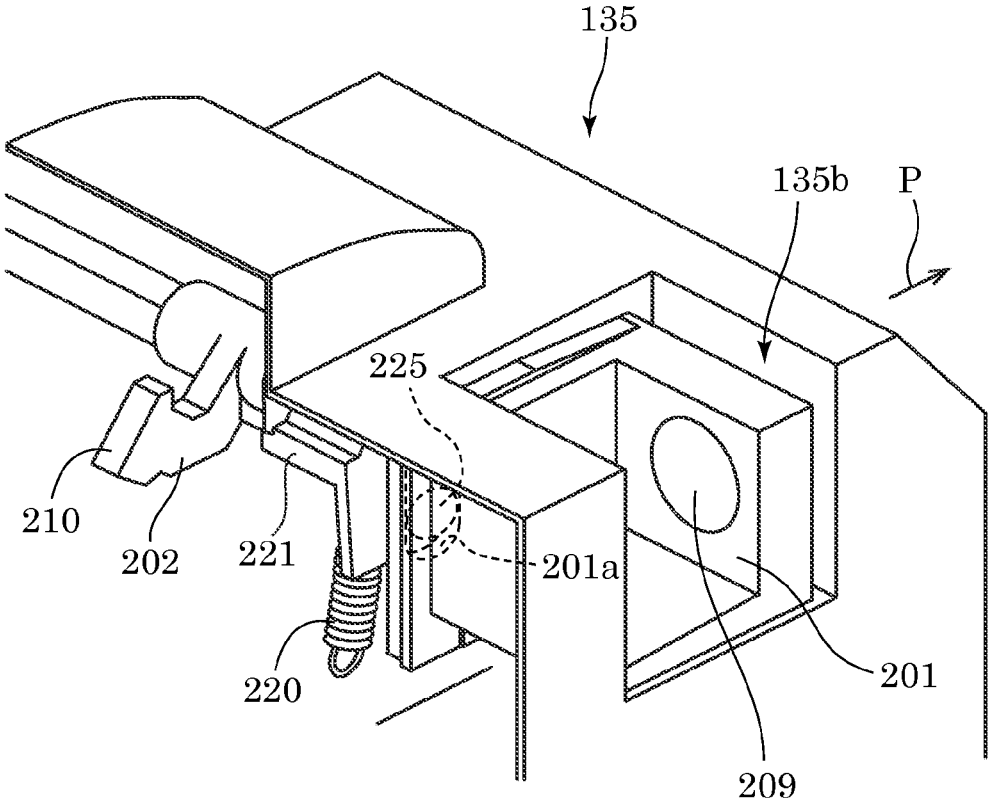
FIG. 5 illustrates the lock portion of the embodiment.
Figure 6A:
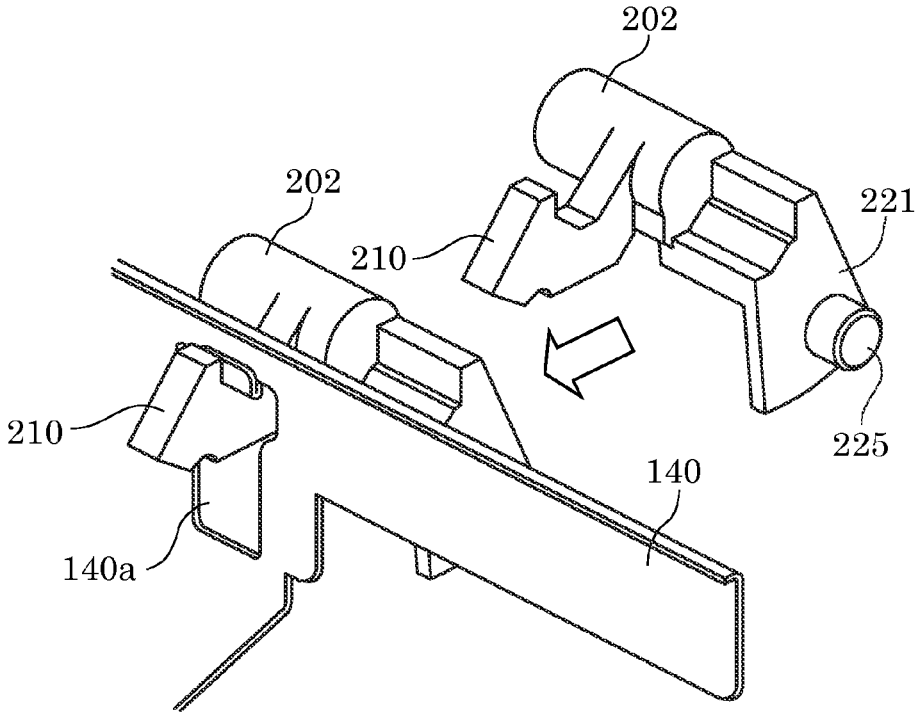
FIG. 6A is a perspective view showing a locking operation of a first interlocked hook of the lock portion of the embodiment.

A lock member 221 shown in FIG. 6A and described later is attached at the one end portion of the locking shaft 206 where the first interlocked hook 202 is provided. Still further, another end of a spring 220 whose one end is connected to an attachment portion not shown of the duplex unit 135 as shown in FIG. 5 is connected to the lock member 221. Then, due to the spring 220, the locking shaft 206 is biased in a direction of turning the first and second interlocked hooks 202 and 203 upward through the lock member 221. It is noted that an upward turn of the lock member 221 biased by the spring 220 is restricted by a stopper not shown. Still further, as shown in FIG. 6A, an engaging protrusion 225 is formed on a side opposite from the locking shaft 206 of the lock member 221. As shown in FIG. 5, the engaging protrusion 225 is slidably engaged with an engage groove 201*a* formed on a side facing the lock member 221 of the opening/closing lever 201 and which is long in a vertical direction.

Then, when the opening/closing lever 201 is pressed in a direction of an arrow P, the engage groove 201*a* is moved in the same direction. Along with the move of the engage groove 201*a*, the engaging protrusion 225 moves also in the same direction. Then, due to the move of the engage protrusion 225, the lock member 221 rotates centering on the lock shaft 206. Thereby, the locking shaft 206 provided with the first and second interlocked hooks 202 and 203 at the widthwise both ends thereof turns counterclockwise by resisting against a bias force of the spring 220. Due to this rotation of the locking shaft 206, the first and second interlocked hooks 202 and 203 turn downward.

Figure 6B:
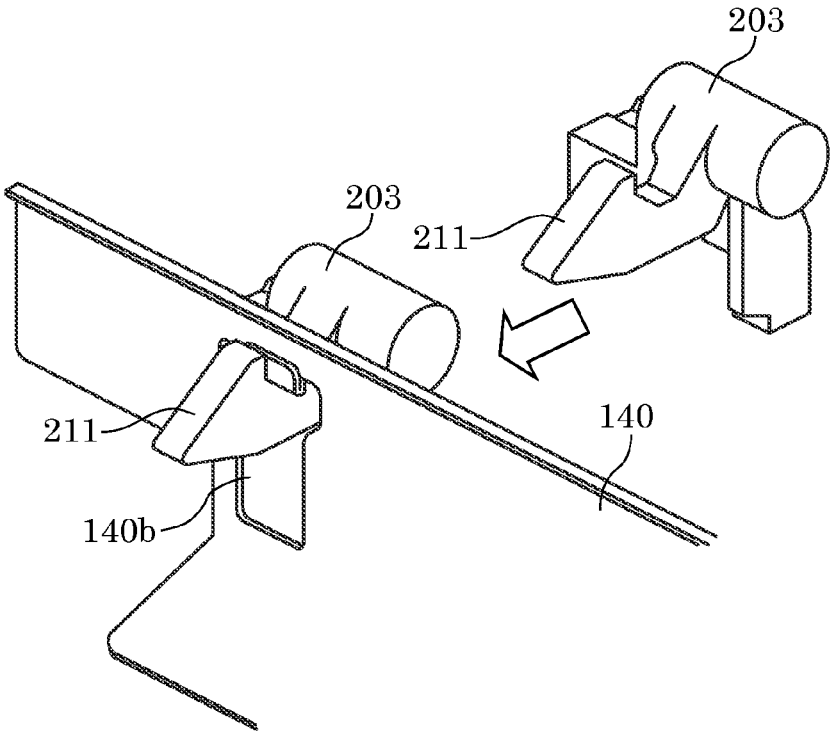
FIG. 6B is a perspective view showing a locking operation of a second interlocked hook of the lock portion of the embodiment.

Here, inclined convex portions 210 and 211, i.e., lock pieces, are formed to project as shown in FIGS. 6A and 6B at upper surface part of edge portions of the first and second interlocked hooks 202 and 203. Still further, as shown in FIGS. 6A and 6B, the storage portion 100D (see FIG. 3) is provided with a hooking sheet metal 140, i.e., a lock portion, locking the first and second interlocked hooks 202 and 203. The hooking sheet metal 140 is provided with square holes 140*a* and 140*b*. Then, when the duplex unit 135 is moved in a direction of an arrow to be stored within the storage portion 100D and when the first and second interlocked hooks 202 and 203 arrive at the hooking sheet metal 140, the convex portions 210 and 211 are depressed by upper edge portions of the square holes 140*a* and 140*b*, respectively.

Thereby, the first and second interlocked hooks 202 and 203 turn downward while turning the locking shaft 206 counterclockwise by resisting against the bias force of the spring 220 and pass through the hooking sheet metal 140, respectively, as shown in FIGS. 6A and 6B. Then, when the convex portions 210 and 211 pass through the hooking sheet metal 140, the locking shaft 206 turns clockwise and returns to its original position by the bias force of the spring 220. Due to that, the first interlocked hook 202 moves to a lock position where the convex portion 210 is locked by the square hole 140*a* of the hooking sheet metal 140 as shown in FIG. 6A. The second interlocked hook 203 also moves to a lock position where the convex portion 211 is locked by the square hole 140*b* of the hooking sheet metal 140 as shown in FIG. 6B. It is noted that the first and second interlocked hooks 202 and 203 are held at the lock positions, respectively, by the spring 220 after being locked by the square holes 140*a* and 140*b*.

The third interlocked hook 204 is vertically turnably connected to the link arm 208 shown in FIG. 8 through a rotating shaft 204*b* and is biased so as to turn upward by a spring 222. It is noted that the third interlocked hook 204 biased by the spring 222 is restricted from turning upward by a stopper not shown and provided in the link arm 208. The independent hook 205 provided at the other end portion at the lower part of the duplex unit 135 is vertically turnably connected to the support portion 135*a* through a rotating shaft 205*b* and is biased so as to turn upward by a spring 223. The independent hook 205 biased by the spring 223, i.e., an elastic member, is restricted from turning upward by a stopper not shown and provided in the support portion 135*a*.

Figure 7A:
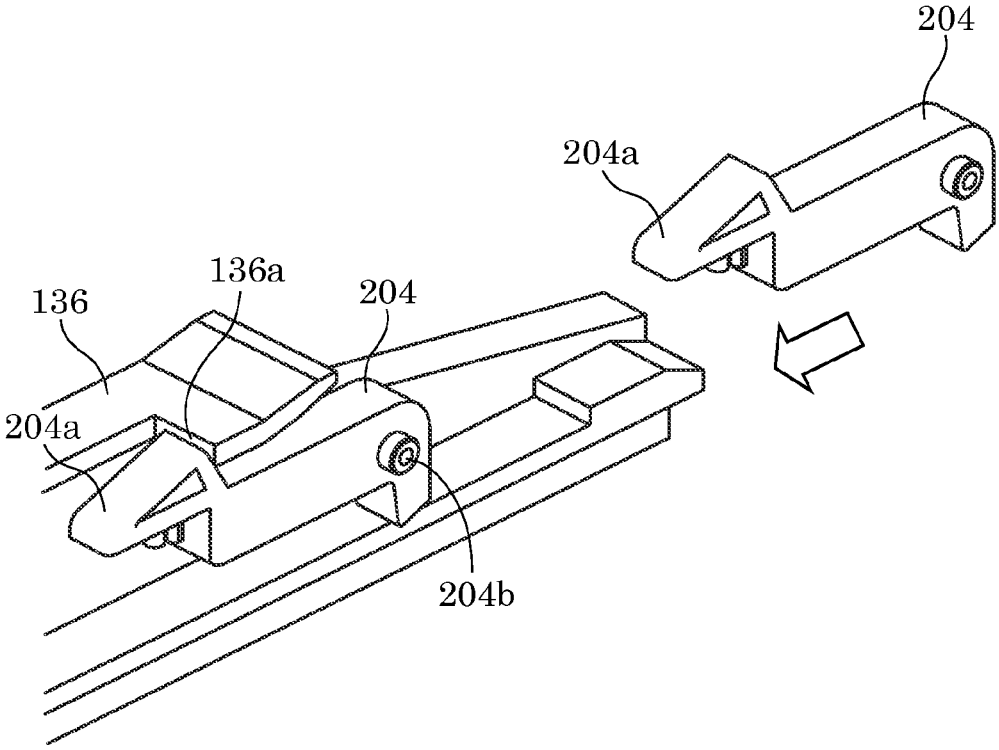
FIG. 7A is a perspective view showing a locking operation of a third interlocked hook of the lock portion of the embodiment.
Figure 7B:
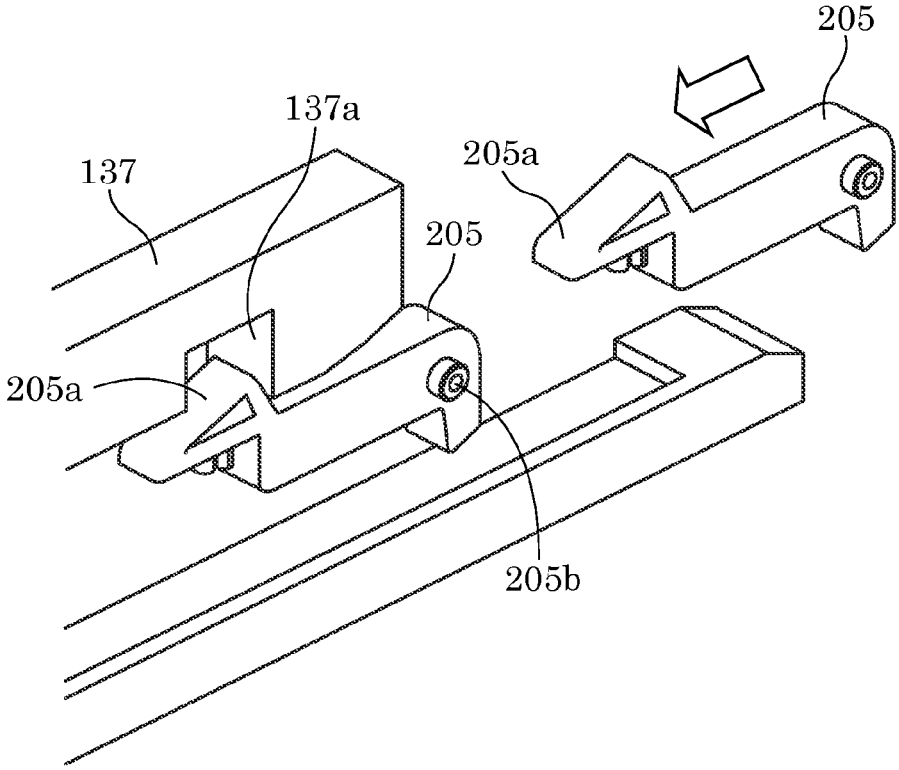
FIG. 7B is a perspective view showing a locking operation of an independent hook of the lock portion of the embodiment.

As shown in FIGS. 7A and 7B, inclined convex portions 204*a* and 205*a* are formed on upper surface parts of edge portions of the third interlocked hook 204 and the independent hook 205. Still further, a hooking rib 136*a* is provided along a guide rail 136 on the third interlocked hook side and a looking concave portion 137*a* is formed at an under surface of a guide rail 137 on the independent hook side.

Then, when the duplex unit 135 is moved in a direction of an arrow and stored into the storage portion 100D, the third interlocked hook 204 passes through the hooking rib 136*a* while being depressed by the hooking rib 136*a* of the guide rail 136 as shown in FIG. 7A. When the third interlocked hook 204 passes through the hooking rib 136*a*, the third interlocked hook 204 turns upward by being biased by the spring 222 and moves to a lock position where the convex portion 204*a* is locked by the hooking rib 136*a*.

Still further, as shown in FIG. 7B, the independent hook 205 arrives at the looking concave portion 137*a* formed at the lower surface of the guide rail 137 while being depressed by the lower surface of the guide rail 137 and is then turned upward by the spring 223. Thereby, the independent hook 205 moves to a lock position where the convex portion 205*a* is locked by the looking concave portion 137*a*. When the duplex unit 135 is thus stored in the storage portion 100D, the duplex unit 135 is locked in the storage portion 100D by the first through third interlocked hooks 202 through 204 and the independent hook 205 moved respectively to the lock positions.

As described above, as shown in FIG. 8, the lock mechanism 200*a* includes the first through third interlocked hooks 202, 203 and 204, the independent hook 205, the locking shaft 206, the wire 207, the link arm 208, the lock member 221, and the springs 220, 222 and 223 in the present embodiment.

Meanwhile, the duplex unit 135 locked by the lock portion 200 is unlocked by operating the opening/closing lever 201.

Here, the opening/closing lever 201 is provided slidably in a rear direction at an end portion of the duplex unit 135 and is slidingly moved rearward in unlocking the duplex unit 135 locked by the lock portion 200 in the present embodiment. That is, as shown in FIG. 10, an operating direction P of the opening/closing lever 201 in unlocking the lock mechanism 200*a* is the same with the drawing direction X of the duplex unit 135.

It is noted that as shown in FIG. 8, the opening/closing lever 201 is linked with the locking shaft 206 through the intermediary of the lock member 221 as described above. Thereby, when the opening/closing lever 201 is slindingly moved rearward, the locking shaft 206 turns and due to that, the first and second interlocked hooks 202 and 203 turn downward, i.e., in the direction of being unlocked from the square holes 140*a* and 140*b* of the hooking sheet metal 140. Still further, due to the turn of the lock shaft 206, the wire 207 is wound up and the link arm 208 is pulled up. Along with that, the third interlocked hook 204 moves downward, i.e., in the direction of being unlocked from the hooking rib 136*a*. That is, the turn of the locking shaft 206 is transmitted to the third interlocked hook 204 by the wire 207 through the intermediary of the link arm 208, so that the third interlocked hook 204 is moved.

As shown in FIG. 2, the lock mechanism 200*a* interlocking the first through third interlocked hooks 202 through 204 is composed of the lock shaft 206 and the wire 207 in the present embodiment. It is noted that it is possible to improve user's operability in opening the duplex unit 135 by linking and interlocking the first through third interlocked hooks 202 through 204 with the opening/closing lever 201 through the intermediary of the lock shaft 206 as compared to a case of individually operating the respective hooks 202 through 204. Still further, the independent hook 205 located on an operation side is configured independently from the first through third interlocked hooks 202 through 204 so that no large operational load is generated in opening/closing the duplex unit 135 by means of the opening/closing lever 201. The independent hook 205 is also configured independently from the first through third interlocked hooks 202 through 204 so that the user can readily feel an operation feeling given by the force of the spring during the operation and detect unbalanced closure of the duplex unit 135.

Next, an operation for drawing the duplex unit 135 out of the image forming apparatus 100 including the lock portion 200 constructed as described above will be explained. In a case where jamming of the sheet or the like occurs in the duplex unit 135 for instance, the user slidingly moves the opening/closing lever 201 rearward at first. Thereby, the locking shaft 206 turns, and the first and second interlocked hook 202 and 203 turn downward and move to the unlock positions where the first and second interlocked hooks 202 and 203 are unlocked from the square holes 140*a* and 140*b* of the hooking sheet metal 140.

Along also with the turn of the locking shaft 206, the wire 207 is pulled up and the link arm 208 rocks centering on the rocking shaft 208*a* shown in FIG. 8 in a direction in which the third interlocked hook 204 drops by resisting against the bias force of the spring 222. Thereby, the third interlocked hook 204 is unlocked from the hooking rib 136*a* of the guide rail 136. Thus, when the opening/closing lever 201 is slidingly moved rearward, the first through third interlocked hooks 202 through 204 move from the lock positions to the unlock positions, respectively, making it possible to move the duplex unit 135 in the drawing direction. It is noted that the opening/closing lever 201 is biased forward by a spring 224 shown in FIG. 8 and moves while resisting against a bias force of this spring 224 when the opening/closing lever 201 is operated by the user in unlocking the first through third interlocked hooks 202 through 204.

Figure 9:
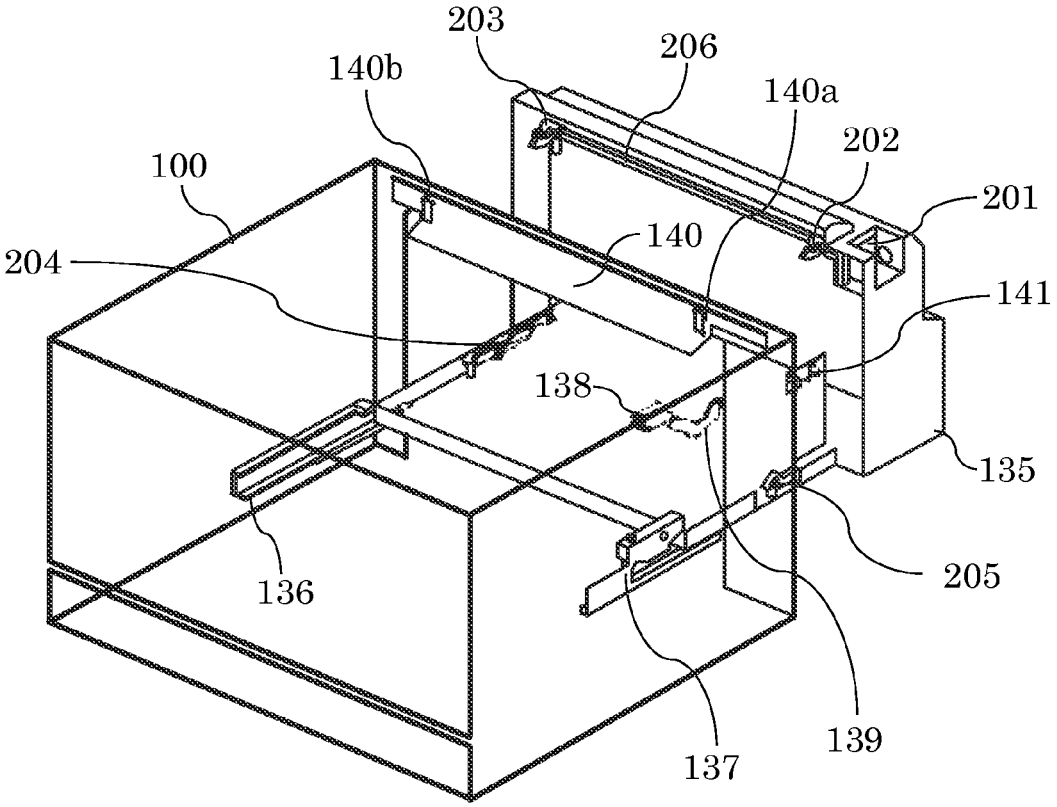
FIG. 9 is a perspective view showing a state in which the duplex unit of the embodiment is drawn out of an apparatus body.

Then, when the user moves the duplex unit 135 in the drawing direction, the independent hook 205 moves to the unlock position where the independent hook 205 drops by resisting against the bias force of the spring 223 biasing the independent hook 205 and is unlocked from the engage concave portion 137*a*. Thereby, the duplex unit 135 is unlocked from the four hooks 202 through 205 of the lock portion 200 and can be drawn out as shown in FIGS. 9 and 4.

Next, an operation for storing the duplex unit 135 that has been drawn out to the storage portion 100D of the apparatus body 100A will be explained. When the unjamming work or the like is finished, the user slides the duplex unit 135 in a storage direction. Thereby, the first and second interlocked hooks 202 and 203 move to the lock positions, as shown in FIGS. 6A and 6B described above, where they are locked by the hooking sheet metal 140 after passing through the square holes 140*a* and 140*b* of the hooking sheet metal 140. The third interlocked hook 204 and the independent hook 205 also move to the lock positions where the third interlocked hook 204 and the independent hook 205 are locked elastically respectively by the hooking rib 136*a* of the guide rail 136 and the lock concave portion 137*a* of the guide rail 137 as shown in FIGS. 7A and 7B. Thereby, the duplex unit 135 is locked in the state in which the duplex unit 135 is stored in the storage portion 100D by the four hooks 202 through 205 of the lock portion 200.

By the way, a liquid crystal display portion 251 and a display panel 250, i.e., a display portion, including various buttons 252 are provided at one end portion of the upper surface part 100Aa of the apparatus body 100A as shown in FIG. 10 in the present embodiment. Then, when the unjamming process is conducted, a procedure of the unjamming process is displayed on the liquid crystal display portion 251 of the display panel 250. It is noted that the display panel 250 is arranged so that the user can confirm the liquid crystal display portion 251 and operate the various buttons 252 by standing in front of the apparatus body 100A. The display panel 250 is disposed at one end portion in the orthogonal direction Y orthogonal to the drawing direction X of the duplex unit 135 in the present embodiment. It is noted that although the display panel 250 is disposed at one end side of the orthogonal direction Y in the present embodiment, the display panel 250 may be disposed on both end sides of the orthogonal direction Y.

Still further, in the present embodiment, the opening/closing lever 201 for drawing the duplex unit 135 out of the apparatus body 100A by unlocking the lock portion 200 is disposed at the upper surface of a right end portion of the duplex unit 135 behind the display panel 250 as shown in FIG. 10. That is, the opening/closing lever 201 operated in unlocking the lock portion 200 is provided at the end portion in the orthogonal direction Y of the upper surface part of the duplex unit 135. The opening/closing lever 201 is provided with an operating surface 209 for sliding the opening/closing lever 201 as shown in FIG. 5 described above. As shown in FIG. 10, the opening/closing lever 201 is provided in a region facing the display panel 250 at the upper surface part of the duplex unit 135, i.e., at the one end portion in the orthogonal direction Y of the duplex unit 135, in the present embodiment. Thereby, the opening/closing lever 201 is disposed so as to face the display panel 250 on a back side in the drawing direction X. It is noted that although the opening/closing lever 201 is disposed at one end side of the orthogonal direction Y in the present embodiment, the opening/closing lever 201 may be disposed on both end sides of the orthogonal direction Y.

Still further, a stacking portion 100E is provided at a substantially center part in the upper surface part 100Aa of the apparatus body 100A in the present embodiment. The stacking portion 100E is configured to be able to stack a discharged sheet S on which an image has been formed by the image forming portion 100B. Then, the display panel 250 is provided adjacent to the stacking portion 100E in the orthogonal direction Y. Then, the opening/closing lever 201 is provided in a side in the drawing direction rather than the stacking portion 100E and the display panel 250. It is noted that although the stacking portion 100E is disposed at a substantially center part in the upper surface part 100Aa in the present embodiment, at least part of the stacking portion 100E may be disposed at a substantially center part of the upper surface part 100Aa of the apparatus body 100A.

It is noted that as shown in FIG. 5, a concave portion 135*b* is formed on the upper surface part of the duplex unit 135 and the opening/closing lever 201 is slidably disposed in the concave portion 135*b* in the present embodiment. This arrangement enables to suppress the duplex unit 135 from being enlarged and enables the user to readily find the opening/closing lever 201 from the font of the apparatus body 100A.

Then, when a force is applied to the operating surface 209 in a direction from the front to the back of the apparatus body 100A as indicated by an arrow P in FIGS. 5 and 10 in drawing out the duplex unit 135, the opening/closing lever 201 slide in an unlock direction by resisting against the force of the spring 224. When the opening/closing lever 201 thus slides in the unlock direction, the lock portion 200 is unlocked as described above and it becomes possible to draw out the duplex unit 135.

After that, the duplex unit 135 can be drawn out of the back of the apparatus body 100A shown in FIG. 4 by applying a force to the duplex unit 135 in the same direction with the direction in which the opening/closing lever 201 is slid, i.e., in the drawing direction X. It is noted that after drawing the duplex unit 135 out, the opening/closing lever 201 returned to its original position by the spring 224 shown in FIG. 8 when the force applied to the operating surface 209 is released. Then, after drawing the duplex unit 135 out as described above, the user unjams a sheet following the procedure for removing the jammed sheet displayed on the display panel 250.

As described above, in the present embodiment, the opening/closing lever 201 is provided at the one end portion in the width direction Y on the back side facing the display panel 250 as shown in FIG. 10 and the operating direction in unlocking the opening/closing lever 201 is made same with the drawing direction X of the duplex unit 135. Thereby, the user can unlock and draw out the duplex unit 135 by operating the opening/closing lever 201. Still further, because the opening/closing lever 201 is provided at the one end portion in the width direction Y facing the display panel 250, the user can operate the opening/closing lever 201 while confirming messages displayed on the display panel 250 concerning the drawing operation of the duplex unit 135 such as the procedure of the unjamming process.

That is, in the present embodiment, the opening/closing lever 201 is provided so as to face the display panel 250 and the operating direction of the opening/closing lever 201 is made same with the drawing direction X of the duplex unit 135. Thereby, the duplex unit 135 can be readily drawn out by operating the opening/closing lever 201. Still further, because a process after drawing out the unit can be made while confirming the display panel 250, it is possible to reliably carry out the process such as the unjamming process without erroneous operation.

It is noted that while the duplex unit 135 conveying a sheet on which an image has been formed on one surface thereof again to the image forming portion 100B has been exemplified so far as the unit drawably stored in the apparatus body 100A, the present invention is not limited to that and is applicable also to another unit such as a sheet feed cassette.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-236203, filed Nov. 14, 2013 which is hereby incorporated by reference herein in its entirety.

What is claimed is:

1. An image forming apparatus comprising:

an apparatus body;

a unit stored in the apparatus body, the unit being movable in a moving direction;

a lock mechanism provided in the unit and configured to lock the unit in a state in which the unit is stored in the apparatus body;

a display portion provided on an upper surface of the apparatus body on one end side in an orthogonal direction orthogonal to the moving direction; and an operating portion provided on an upper surface of the unit on the one end side of the orthogonal direction and operated in unlocking the lock mechanism.

2. The image forming apparatus according to claim 1, further comprising:

an image forming portion configured to form an image on a sheet; and a stacking portion configured such that at least part of thereof is disposed at a substantially center part of the upper surface part of the apparatus body and configured to be able to stack a discharged sheet on which the image has been formed by the image forming portion;

wherein the unit is disposed on the back side of the apparatus body, and the display portion is provided adjacent to the stacking portion in the orthogonal direction on the upper surface part of the apparatus body.

3. The image forming apparatus according to claim 2, wherein the unit is configured to convey the sheet on which the image has been formed on one surface thereof again to the image forming portion.

4. The image forming apparatus according to claim 1, wherein the unit is disposed on a back side of the apparatus body, and the operating portion is disposed such that the operating portion can be operated from a front side of the apparatus body.

5. The image forming apparatus according to claim 4, wherein the unit is configured to be drawn out of the back side of the apparatus body.

6. The image forming apparatus according to claim 1, wherein an operation direction of the operating portion in unlocking the lock mechanism is the same with a direction in which the unit is drawn out.

7. The image forming apparatus according to claim 6, wherein the unit includes a concave portion configured to store the operating portion such that the operating portion can be operated.

8. An image forming apparatus comprising:

an apparatus body;

an image forming portion disposed in the apparatus body and configured to form an image on a sheet;

a unit stored in the apparatus body and being movable in a moving direction;

a lock mechanism configured to lock the unit in a state in which the unit is stored in the apparatus body;

a display portion provided at one end side of a orthogonal direction orthogonal to the moving direction on an upper surface of the apparatus body; and an operating portion provided at the one end side of the orthogonal direction on an upper surface of the image forming apparatus and operated in unlocking the lock mechanism.

9. The image forming apparatus according to claim 8, further comprising a stacking portion provided on the upper surface part of the apparatus body and configured to be able to stack a discharged sheet on which an image has been formed by the image forming portion, wherein the display portion is provided adjacent to the stacking portion in the orthogonal direction.

10. The image forming apparatus according to claim 9, wherein the operating portion is provided on a side in a drawing direction.

11. The image forming apparatus according to claim 8, wherein the operating portion is disposed on a back side of the image forming apparatus.

12. The image forming apparatus according to claim 8, wherein the moving of the unit is a short direction of the apparatus body and the orthogonal direction is a long direction of the apparatus body.

13. The image forming apparatus according to claim 8, wherein the unit is configured to convey the sheet on which the image has been formed on one surface thereof again to the image forming portion.

14. The image forming apparatus according to claim 8, wherein the unit is configured to be drawn out of the back side of the apparatus body.

* * * * *